US006419346B1

(12) United States Patent
Nikkel

(10) Patent No.: US 6,419,346 B1
(45) Date of Patent: Jul. 16, 2002

(54) TWO-STEP TRENCH ETCH FOR A FULLY INTEGRATED THERMAL INKJET PRINTHEAD

(75) Inventor: Eric L. Nikkel, Philomath, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/770,723

(22) Filed: Jan. 25, 2001

(51) Int. Cl.[7] ..... B41J 2/05
(52) U.S. Cl. ..... 347/63
(58) Field of Search ..... 347/63, 56, 64, 347/61, 54; 216/27, 4, 48; 29/890.1; 430/311

(56) References Cited

FOREIGN PATENT DOCUMENTS

EP 0244214 A1 11/1987 ..... B41J/3/04
EP 0841167 A2 5/1998 ..... B41J/2/16

*Primary Examiner*—Raquel Yvette Gordon

(57) ABSTRACT

A monolithic printhead is formed using integrated circuit techniques. Thin film layers, including ink ejection elements, are formed on a top surface of a silicon substrate. The various layers are etched to provide conductive leads to the ink ejection elements. At least one ink feed hole is formed through the thin film layers for each ink ejection chamber. A protection layer is formed over the ink feed holes. An orifice layer is formed on the top surface of the thin film layers to define the nozzles and ink ejection chambers. A first trench etch is performed to etch the bottom surface of the substrate. The protection layer is then removed. A second trench etch then self-aligns the trench walls with the ink feed holes. In another embodiment, portions of a field oxide layer, forming a bottom layer in the thin film stack, act as the protection layer within the ink feed openings, and the field oxide portions are removed prior to the second trench etch.

29 Claims, 10 Drawing Sheets

TWO-STEP TRENCH ETCH FOR A FULLY INTEGRATED THERMAL INKJET PRINTHEAD

FIELD OF THE INVENTION

This invention relates to inkjet printers and, more particularly, to a monolithic printhead for an inkjet printer.

BACKGROUND

Inkjet printers typically have a printhead mounted on a carriage that scans back and forth across the width of a sheet of paper feeding through the printer. Ink from an ink reservoir, either on-board the carriage or external to the carriage, is fed to ink ejection chambers on the printhead. Each ink ejection chamber contains an ink ejection element, such as a heater resistor or a piezoelectric element, which is independently addressable. Energizing an ink ejection element causes a droplet of ink to be ejected through a nozzle for creating a small dot on the medium. The pattern of dots created forms an image or text.

Additional information regarding one particular type of printhead and inkjet printer is found in U.S. Pat. No. 5,648,806, entitled, "Stable Substrate Structure For A Wide Swath Nozzle Array In A High Resolution Inkjet Printer," by Steven Steinfield et al., assigned to the present assignee and incorporated herein by reference.

As the resolutions and printing speeds of printheads increase to meet the demanding needs of the consumer market, new printhead manufacturing techniques and structures are required.

SUMMARY

Described herein is a monolithic printhead formed using integrated circuit techniques. Thin film layers, including a resistive layer, are formed on a top surface of a silicon substrate. The various layers are etched to provide conductive leads to the heater resistor elements. Piezoelectric elements may be used instead of the resistive elements.

At least one ink feed hole is formed through the thin film layers for each ink ejection chamber. In one embodiment, a protective layer is deposited over the ink feed hole area.

An orifice layer is formed on the top surface of the thin film layers to define the nozzles and ink ejection chambers. In one embodiment, a photo-definable material is used to form the orifice layer.

A trench mask is formed on the bottom surface of the substrate. A trench is etched (using, for example, TMAH) through the exposed bottom surface of the substrate. The trench completely etches away portions of the substrate beneath the ink feed holes. The protective layer prevents the TMAH from etching the substrate from the front side through the ink feed hole.

The protective layer is then removed, and a second trench etch is performed. The TMAH solution etches away the substrate portion exposed through the ink feed holes. The second trench etch inherently aligns the edge of the trench with the ink feed holes. This two-step trench etch eases the tolerances for the trench mask and results in a precisely positioned trench, since the trench side walls are ultimately aligned to the thin film openings.

In another embodiment, a separate protection layer is not deposited. Instead, a field oxide (FOX) layer, formed over the substrate as one of the thin film layers, is used for protection. The ink feed holes are etched through the thin film layers down to the FOX layer. A first trench etch is conducted as in the previous embodiment. The portions of the FOX layer in the ink feed hole areas are removed with a buffered oxide etch. A second trench etch is then performed that self-aligns the trench sidewalls to the thin film openings. This process is more economical than the previous embodiment using a separate protection layer.

The resulting fully integrated thermal inkjet printhead can be manufactured to a very precise tolerance since the entire structure is monolithic, meeting the needs for the next generation of printheads.

The process may be used to form openings in devices other than printheads.

DETAILED DESCRIPTION OF THE EMBODIMENTS

Figure 1:
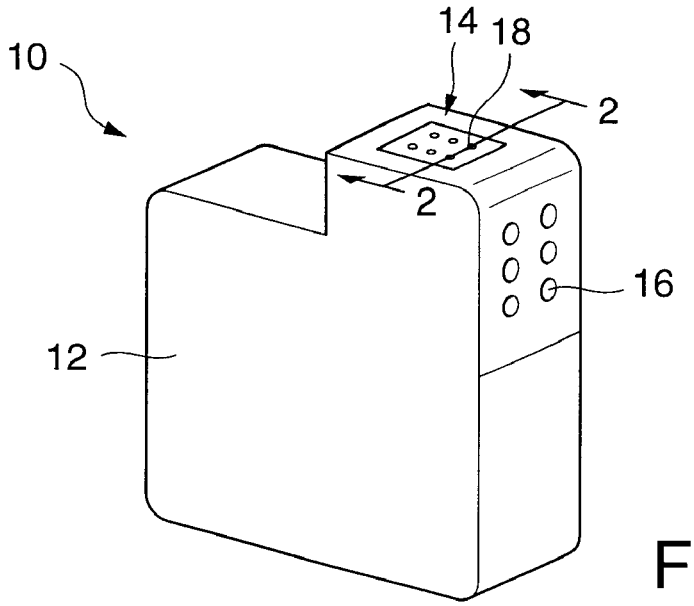
FIG. 1 is a perspective view of one embodiment of a print cartridge that may incorporate any one of the printheads described herein.

FIG. 1 is a perspective view of one type of inkjet print cartridge 10 which may incorporate the printhead structures of the present invention. The print cartridge 10 of FIG. 1 is the type that contains a substantial quantity of ink within its body 12, but another suitable print cartridge may be the type that receives ink from an external ink supply either mounted on the printhead or connected to the printhead via a tube.

The ink is supplied to a printhead 14. Printhead 14, to be described in detail later, channels the ink into ink ejection chambers, each chamber containing an ink ejection element. Electrical signals are provided to contacts 16 to individually energize the ink ejection elements to eject a droplet of ink through an associated nozzle 18. The structure and operation of conventional print cartridges are very well known.

Figure 2:
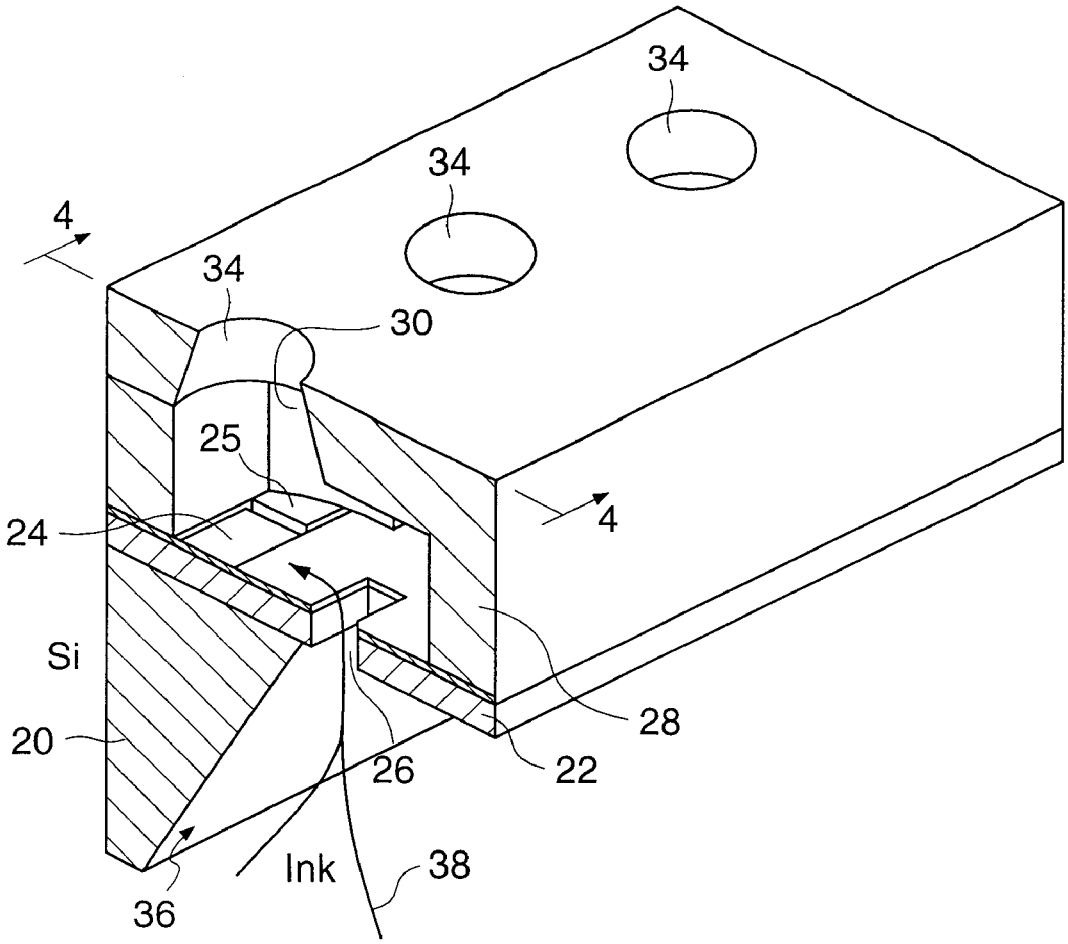
FIG. 2 is a perspective cutaway view of a portion of one embodiment of a printhead in accordance with the present invention.

FIG. 2 is a cross-sectional view of a portion of the printhead of FIG. 1 taken along line 2—2 in FIG. 1.

Although a printhead may have 300 or more nozzles and associated ink ejection chambers, detail of only a single ink ejection chamber need be described in order to understand the invention. It should also be understood by those skilled in the art that many printheads are formed on a single silicon wafer and then separated from one another using conventional techniques.

In FIG. 2, a silicon substrate 20 has formed on it various thin film layers 22, to be described in detail later. The thin film layers 22 include a resistive layer for forming resistors 24. Other thin film layers perform various functions, such as providing electrical insulation from the substrate 20, providing a thermally conductive path from the heater resistor elements to the substrate 20, and providing electrical conductors to the resistor elements. One electrical conductor 25 is shown leading to one end of a resistor 24. A similar conductor leads to the other end of the resistor 24. In an actual embodiment, the resistors and conductors in a chamber would be obscured by overlying layers.

Ink feed holes 26 are formed completely through the thin film layers 22. There may be multiple holes per chamber. Alternately, a manifold may be formed in the orifice layer 28 for providing a common ink channel for a row of ink ejection chambers 30.

An orifice layer 28 is deposited over the surface of the thin film layers 22 and etched to form ink ejection chambers 30, one chamber per resistor 24. Nozzles 34 may be formed using conventional photolithographic techniques.

The silicon substrate 20 is etched to form a trench 36 extending along the length of the row of ink feed holes 26 so that ink 38 from an ink reservoir may enter the ink feed holes 26 for supplying ink to the ink ejection chambers 30. A two-step etch process, described below, is used to precisely align the edges of the trench 36 with the ink feed holes 26.

In one embodiment, each printhead is approximately one-half inch long and contains two offset rows of nozzles, each row containing 150 nozzles for a total of 300 nozzles per printhead. The printhead can thus print at a single pass resolution of 600 dots per inch (dpi) along the direction of the nozzle rows or print at a greater resolution in multiple passes. Greater resolutions may also be printed along the scan direction of the printhead. Resolutions of 1200 or greater dpi may be obtained using the present invention.

In operation, an electrical signal is provided to heater resistor 24, which vaporizes a portion of the ink to form a bubble within the ink ejection chamber 30. The bubble propels an ink droplet through an associated nozzle 34 onto a medium. The ink ejection chamber is then refilled by capillary action.

Figure 3:
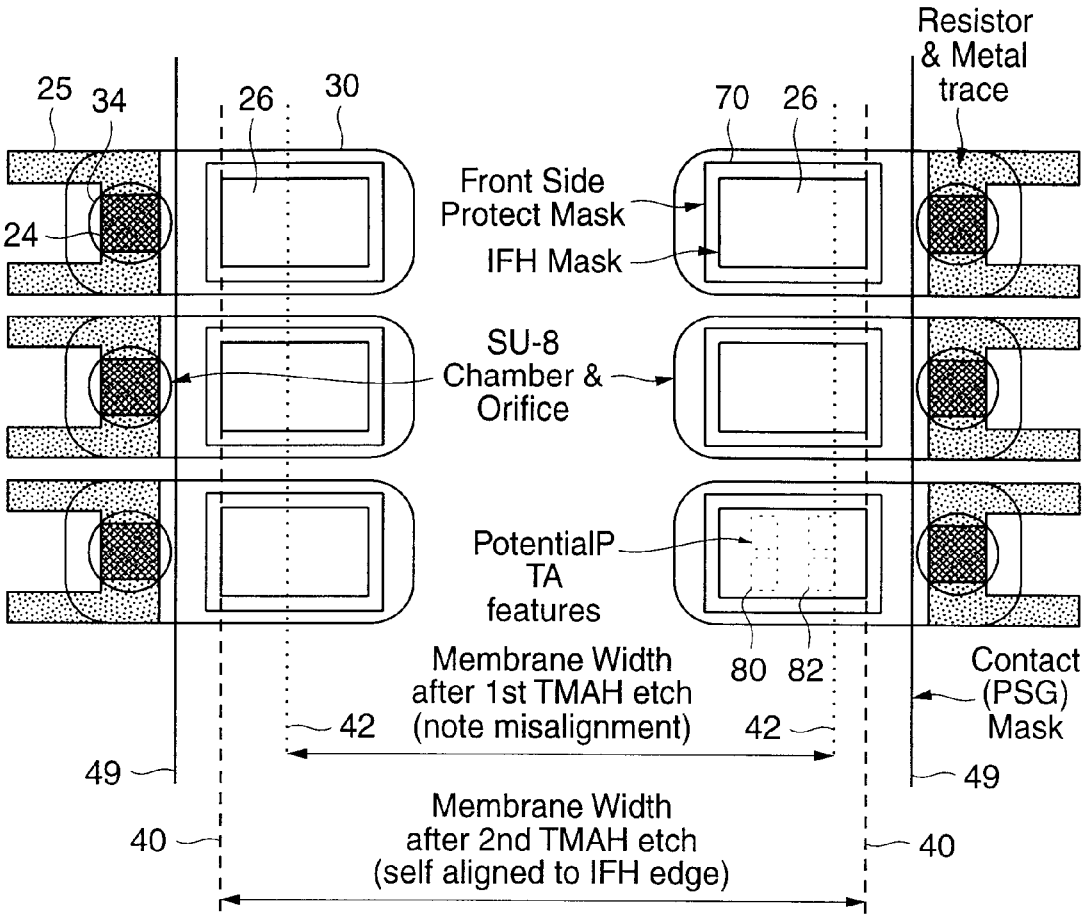
FIG. 3 is a top down partially transparent view of the printhead shown in FIG. 2, showing additional portions of the printhead.

FIG. 3 is a top down view of the printhead of FIG. 2 showing two parallel arrays of ink ejection chambers formed in the printhead. The ink ejection chambers 30 in the two rows may be offset. Elements in the various figures designated with the same numerals may be similar or identical.

The thin film layer shelf above the trench is referred to as a membrane. The width of this membrane is shown in FIG. 3 by the dashed lines 40. The particular method for forming the printhead of FIG. 2 uses a two-step trench etch process. The first trench etch results in a membrane width, shown by dash lines 42, that is narrower than the final membrane width 40. As will described below, this allows the mask for the first trench etch to have a very relaxed tolerance. The trench sidewalls after the second trench etch are self-aligned to the ink feed holes 26 defined by the thin film layers.

Figure 4:
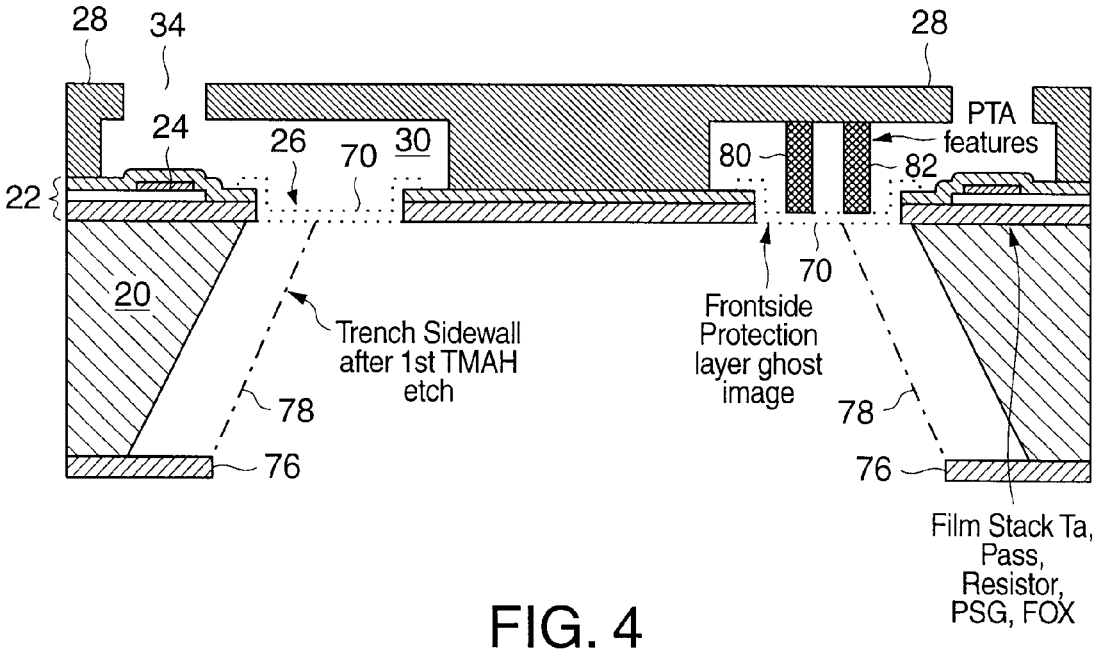
FIG. 4 is a cross-sectional view along line 4—4 in FIG. 2 showing additional portions of th printhead.

FIG. 4 is a cross-sectional view along line 4—4 in FIG. 2, showing the additional portion of the printhead containing the second row of ink ejection chambers. The thin film layers 22, including the resistors 24, are shown simplified. Additional detail of FIG. 4 will be discussed with respect to FIGS. 5 and 6A–6G.

Figure 5:
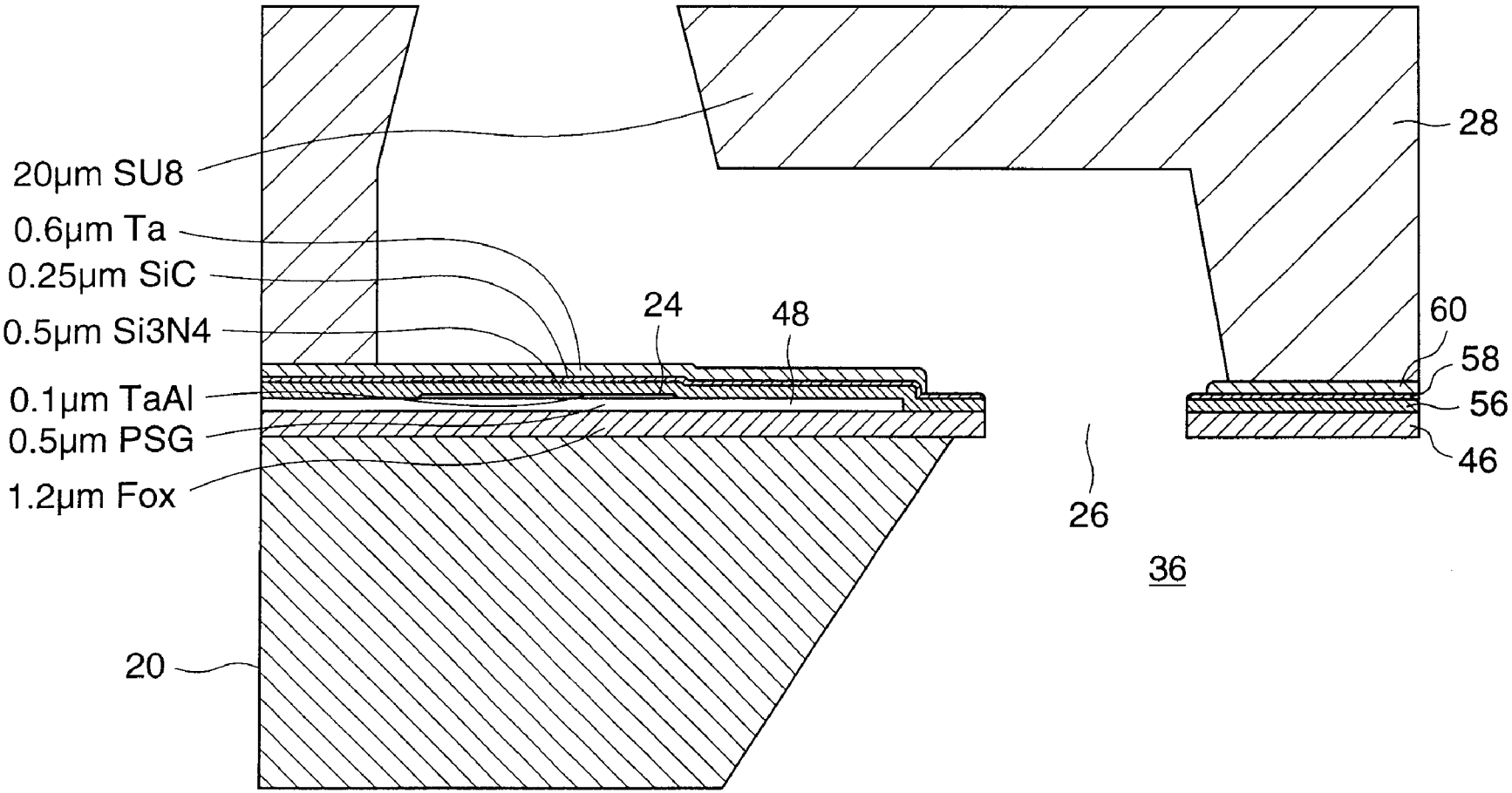
FIG. 5 is a cross-sectional view of the printhead portion of FIG. 2 along line 4—4 showing additional detail of the thin film layers.

FIG. 5 is a cross-sectional view along line 4—4 of FIG. 2 showing a single ink ejection chamber and the associated structure of the printhead. FIG. 5 shows one embodiment of the individual thin film layers, and FIGS. 6A–6G show various steps used to fabricate the printhead of FIGS. 2–5. Conventional deposition, masking, and etching steps are used unless otherwise noted.

Figure 6A:
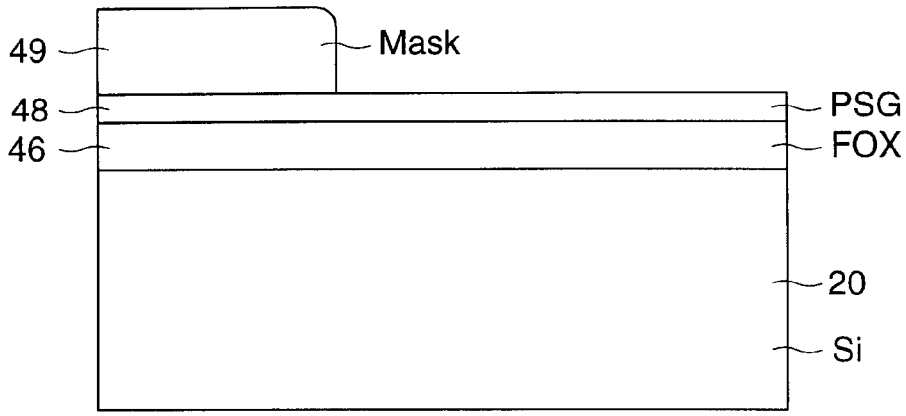
FIGS. 6A–6G are cross-sectional views of a portion of the printhead of FIG. 4 along line 4—4 during various stages of the manufacturing process.

In FIG. 6A, a silicon substrate 20 with a crystalline orientation of <100> is placed in a vacuum chamber. The bulk silicon is about 675 microns thick.

A field oxide layer 46, having a thickness of 1.2 microns, is formed over the silicon substrate 20 using conventional techniques. A phosphosilicate glass (PSG) layer 48, having a thickness of 0.5 microns, is then deposited over the field oxide layer 46 using conventional techniques.

Figure 7:
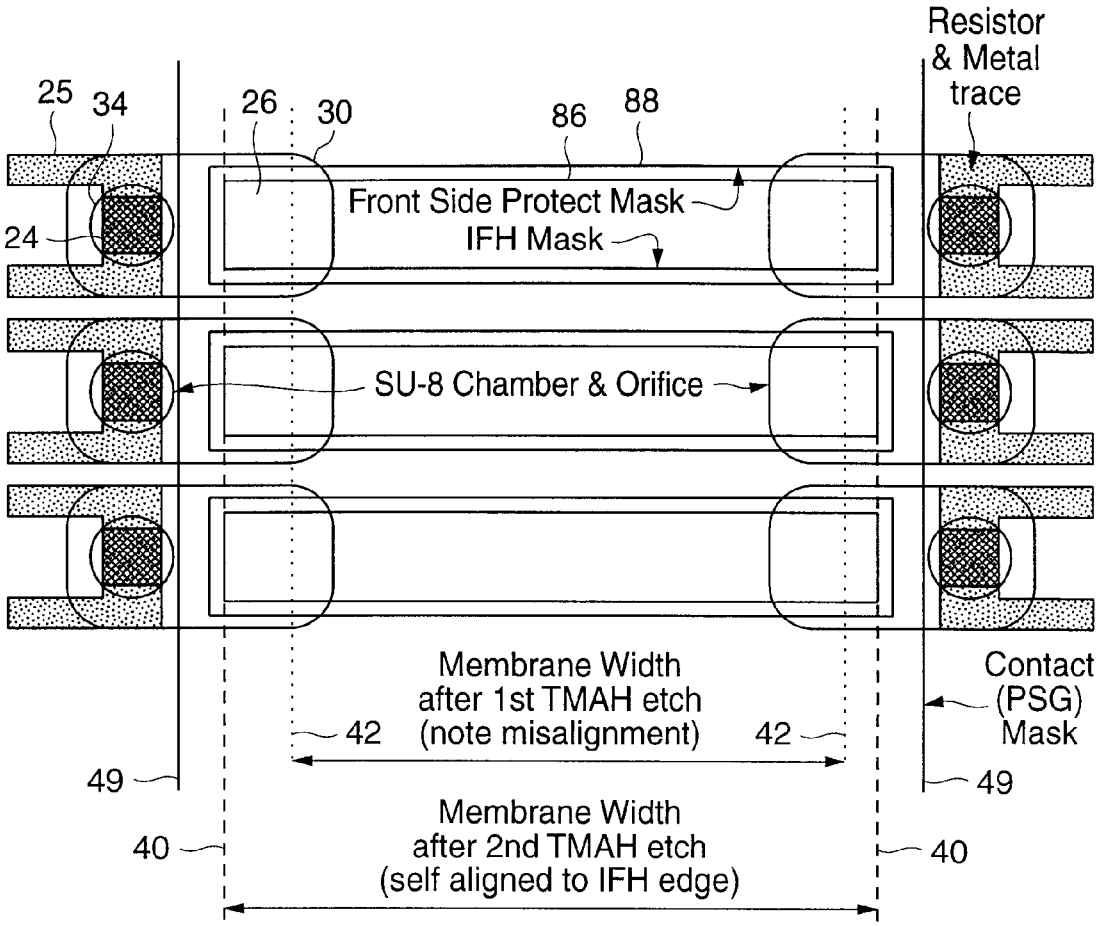
FIG. 7 is a top down partially transparent view of a second embodiment of a printhead.

A mask 49 is formed over the PSG layer 48 using conventional photolithographic techniques. The mask 49 is also shown in FIGS. 3 and 7. The PSG layer 48 is then etched using conventional reactive ion etching (RIE) to pull back the PSG layer 48 from the subsequently formed ink feed hole. This will protect the PSG layer 48 from ink.

A boron PSG or boron TEOS (BTEOS) layer may be used instead of PSG layer 48 and etched in a manner similar to the etching of layer 48.

Figure 6B:
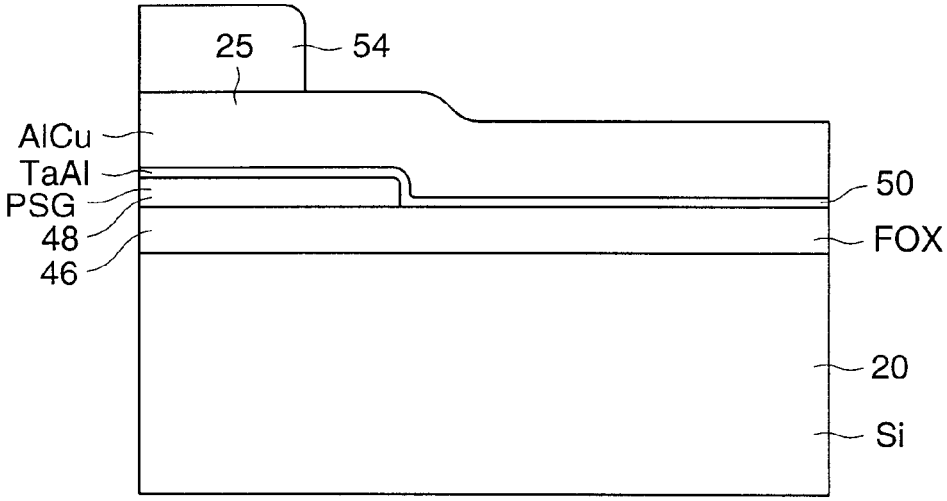

In FIG. 6B, mask 49 is removed and a resistive layer 50 of, for example, tantalum aluminum (TaAl), having a thickness of 0.1 microns, is then the deposited over the PSG layer 48. Other known resistive layers can also be used. A conductive layer 25 of AlCu is then deposited over the TaAl. A mask 54 is deposited and patterned using conventional photolithographic techniques, and the conductive layer 25 and the resistive layer 50 are etched using conventional IC fabrication techniques. Another masking and etching step (not shown) is used to remove the portions of the AlCu over the heater resistors 24, as shown in FIG. 2. The resulting AlCu conductors are outside the field of view of FIGS. 6A–6G.

The etching of the conductive layer 25 and resistive layer 50 define a first resistor dimension (e.g., a width). A second resistor dimension (e.g., a length) is defined by etching the conductive layer 25 to cause the resistive portion to be contacted by the conductive traces at two ends. This technique of forming resistors and electrical conductors is well known in the art. The conductive traces are formed so as to not extend across the middle of the printhead, but run along the edges. Appropriate addressing circuitry and pads are provided on the substrate 20 for providing energizing signals to the resistors 24.

Figure 6C:
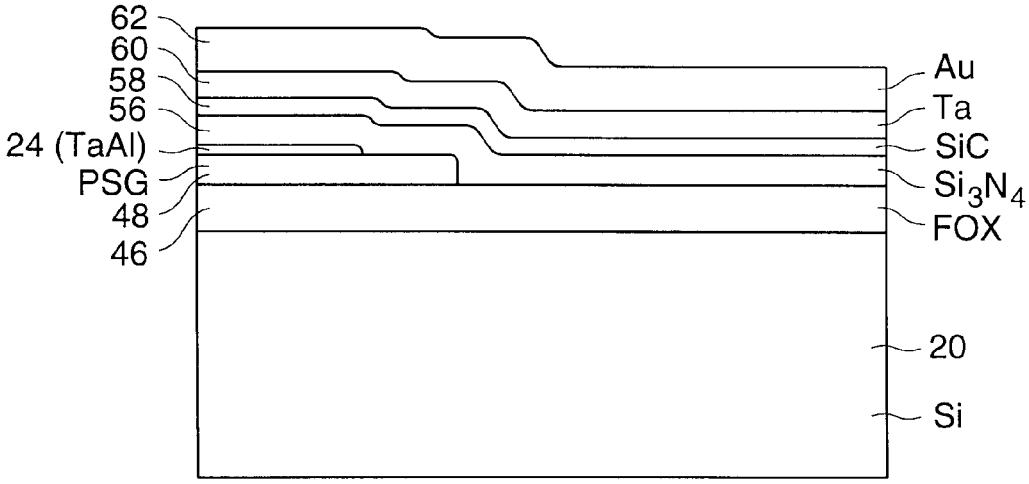

In FIG. 6C, over the resistors 24 and conductive layer 25 is formed a silicon nitride layer 56, having a thickness of 0.5 microns. This layer provides insulation and passivation.

Over the nitride layer 56 is formed a silicon carbide layer 58, having a thickness of 0.25 microns, to provide additional insulation and passivation. The nitride layer 56 and carbide layer 58 now protect the PSG layer 48 from the ink and etchant. Other dielectric layers may be used instead of nitride and carbide.

The passivation layers are then masked (outside the field of view) and etched using conventional techniques to expose portions of the conductive layer 25 for electrical contact to a subsequent gold conductive layer to provide ground lines.

A bubble cavitation layer 60 of tantalum (Ta) is then formed over the carbide layer 58. Gold (Au) 62 is deposited over the tantalum layer 60 and etched to form the ground lines electrically connected to certain ones of the conductive layer 25 traces. The ground lines terminate in bond pads along edges of the substrate 20.

The AlCu and gold conductors may be coupled to transistors formed on the substrate surface. Such transistors are described in U.S. Pat. No. 5,648,806, previously mentioned.

Figure 6D:
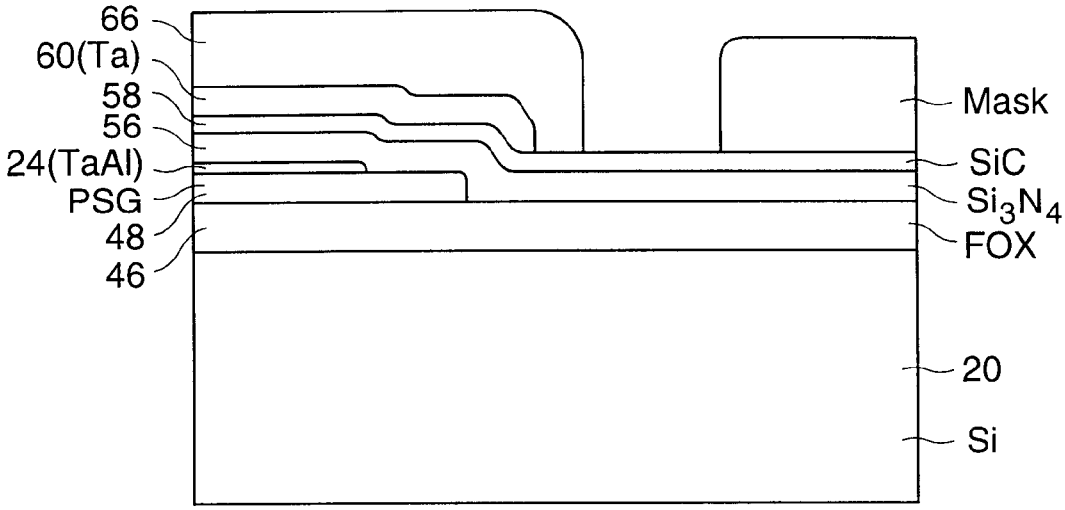

In FIG. 6D, a mask 66 is patterned to expose a portion of the thin film layers to be etched to form the ink feed holes 26 (FIG. 2). Alternately, multiple masking and etching steps may be used as the various thin film layers are formed to etch the ink feed holes.

Figure 6E:
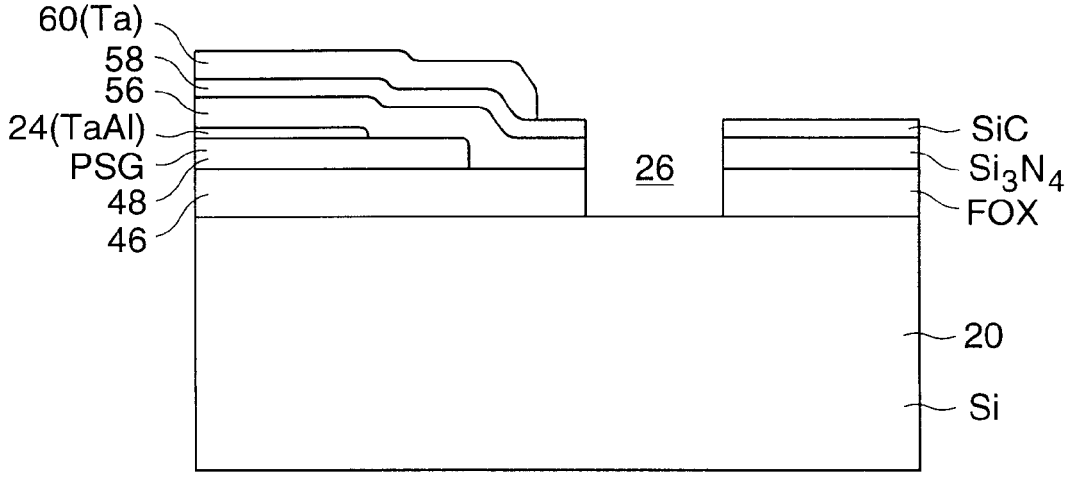

The thin film layers are then etched using an anisotropic etch. This ink feed hole etch process can be a combination of several types of etches (RIE or wet). The etch through the thin film layers may use conventional IC fabrication techniques. The resulting wafer after the etch is shown in FIG. 6E.

When forming the trench 36 of FIG. 2, it is difficult to perfectly align the backside trench mask with the ink feed holes 26. The manufacturing process described below includes a technique to align the trench 36 with the ink feed holes 26.

Figure 6F:
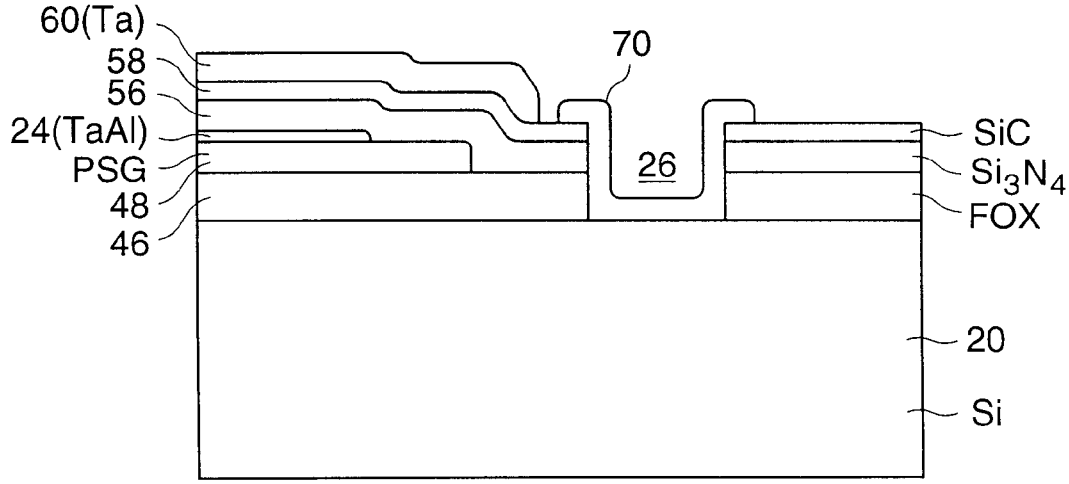

In FIG. 6F, a frontside protection layer 70 is deposited and formed using conventional photolithographic techniques. In one embodiment, the protection layer 70 is a plasma TEOS having a thickness (e.g., 1000 angstroms) that is thin enough so that it can be quickly and easily removed by a buffered oxide etch (BOE) but thick enough that it can withstand exposure to the TMAH (tetramethyl ammonium hydroxide) etchant throughout the approximately fifteen hour trench etch. The protection layer 70 may be any suitable material, including oxides, nitrides, and oxinitrides. A mask for this operation would be the inverse of the ink feed hole mask and biased slightly larger to ensure that the entire ink feed hole opening remains covered with a protection layer 70. FIG. 3 shows the protection layer 70 mask boundary.

Figure 6G:
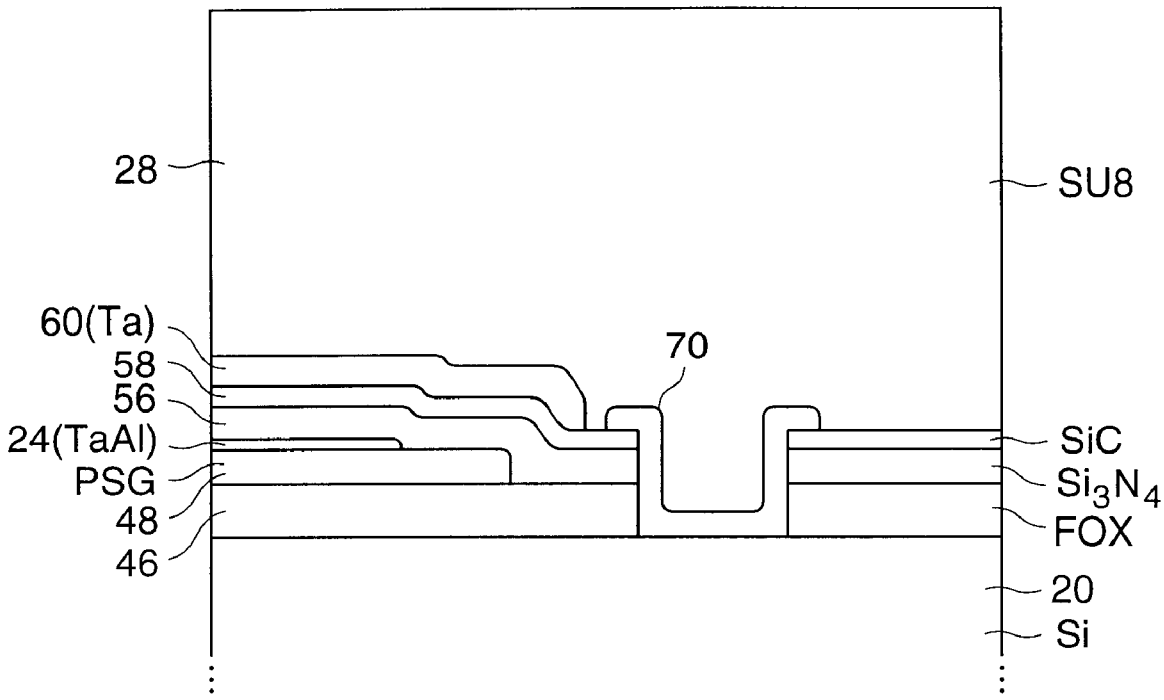

Referring to FIG. 6G, an orifice layer 28 is then deposited and formed. The orifice layer 28 may be formed of a spun-on epoxy called SU8. Orifice layer 28 may alternatively be laminated or screened on. The orifice layer in one embodiment is about 20 microns. The ink chambers 30 (FIG. 2) and nozzles 34 are formed through photolithography. In one technique, a first mask using a half dosage of UV radiation "hardens" the upper surface of the SU8 except in locations where the nozzles 34 are to be formed. A second mask using a full UV dosage then exposes the SU8 in those areas where neither nozzles 34 nor ink ejection chambers 30 are to be formed. After these two exposures, the SU8 is developed, and the hardened portions remain but the nozzle portions and the ink ejection chamber portions of the SU8 are removed.

The thin film layers and formed orifice layer 28 are shown in FIG. 4.

The backside of the wafer is then masked (by mask 76) using conventional techniques to expose the portion of the backside of the wafer to be subjected to the TMAH trench etch. The backside mask 76 may be a FOX hardmask formed using conventional photolithographic techniques. The wafer is dipped into the wet TMAH etch, which forms the angled profile (also defined by the dashed lines 78) shown in FIG. 4. This first etch is conducted for a time sufficient to etch through to the FOX layer 46 and the protection layer 70. The dashed line 78 portion of the trench walls after the first etch extends up to within the ink feed hole area. The resulting membrane width between the trench walls is shown in FIG. 3 by the dashed lines 42.

The trench width will typically be less than 200 microns, and, in one embodiment, is between 20–60 microns. The backside masking may be misaligned by a large margin. Such misalignment would normally restrict the area of the ink feed hole and have an adverse effect on the fluid properties of the printhead. However, the process described below avoids any adverse effects of such misalignment.

The wafer is then placed in a BOE solution that removes the protection layer 70. A "ghost" image of the protection layer 70 is shown in FIG. 4.

The wafer is again subjected to a TMAH wet etch, where the etchant now contacts the portion of the silicon revealed through the ink feed holes 26. This inherently produces the angled etch self-aligned with the edge of the ink feed hole 26, shown in FIG. 4. During this second trench etch, the trench widens at a rapid rate until it reaches the edge of the ink feed holes. FIGS. 3 and 4 intentionally show the first trench etch being misaligned (see lines 42 in FIG. 3) with respect to the ink feed holes 26 to show that the resulting trench, after the second etch, has trench edges aligned with the ink feed holes (see lines 40 in FIG. 3).

The trench 36, in one embodiment, extends the length of a row of ink ejection chambers. Any one of several etch techniques could be used, wet or dry. Examples of dry etches include $XeF_2$ and $SiF_6$. Examples of appropriate wet etches include ethylene diamine pyrocatecol (EDP), potassium hydroxide (KOH), and TMAH. Other etches may also be used. Any one of these or a combination thereof could be used for this application.

The resulting wafer is then sawed to form the individual printheads. A flexible circuit is used to provide electrical access to the conductors on the printhead. The resulting assembly is then affixed to a plastic print cartridge, such as that shown in FIG. 1, and the printhead is sealed with respect to the print cartridge body to prevent ink seepage.

Additional details of forming thin film layers may be found in U.S. application Ser. No. 09/384,817, entitled "Fully Integrated Thermal Inkjet Printhead Having Thin Film Layer Shelf," filed Aug. 27, 1999, by Naoto Kawamura et al., assigned to the present assignee and incorporated herein by reference.

In one embodiment, the orifice layer 28 is formed to also provide posts 80, 82 (FIG. 4) for blocking relatively large ink particles from entering into the chamber 30. FIG. 3 illustrates four such posts in dashed outline for each chamber. The posts 80, 82 may be formed by the same techniques used to form the chambers 30.

The trench 36 may extend the length of the printhead or, to improve the mechanical strength of the printhead, only extend a portion of the length of the printhead beneath the ink ejection chambers. A passivation layer may be deposited on the substrate 20 if reaction of the substrate with the ink is a concern.

Figure 8:
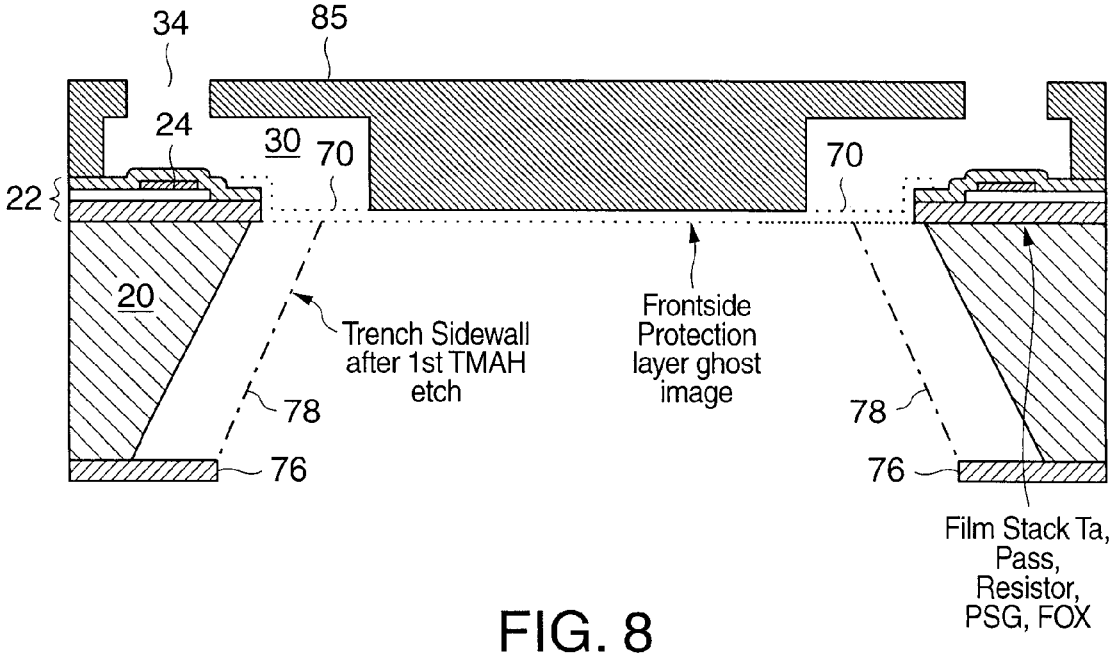
FIG. 8 is a cross-sectional view of the second embodiment printhead.

FIGS. 7 and 8 illustrate an alternative embodiment of the invention formed by steps virtually identical to the steps shown in FIGS. 4–6G except that the ink feed hole etch of the thin film layers extends across the center portion of the printhead, and the orifice layer 85 is used to define ink hole boundaries.

As seen in FIG. 7, the ink feed hole mask 86 extends between two opposing ink ejection chambers 30, and the frontside protection mask 88 is slightly larger. Narrow thin film walls separate the etched areas in the central portion of the printhead.

Figure 9:
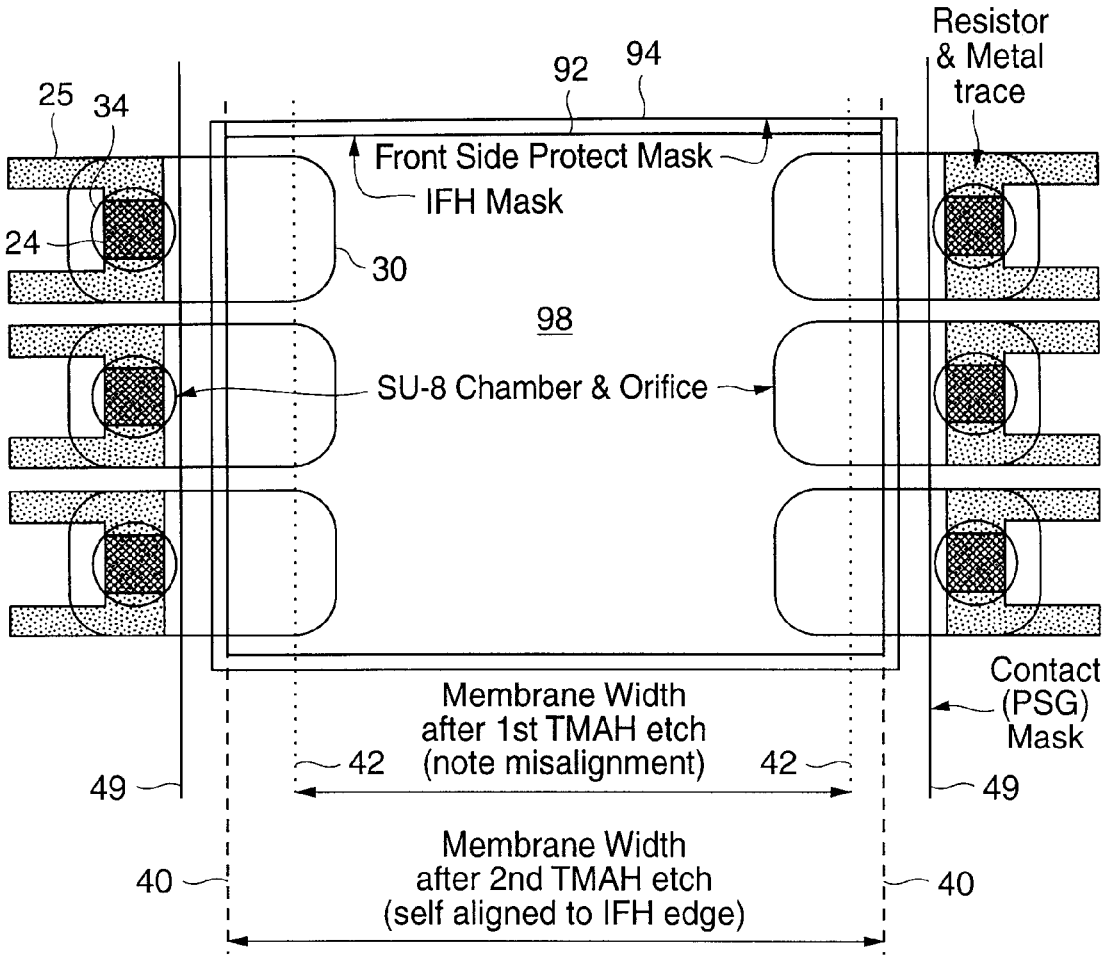
FIGS. 9 and 10 illustrate a variation of the structures of FIGS. 7 and 8, where a central rectangular ink feed area is formed through the thin film layers.
Figure 10:
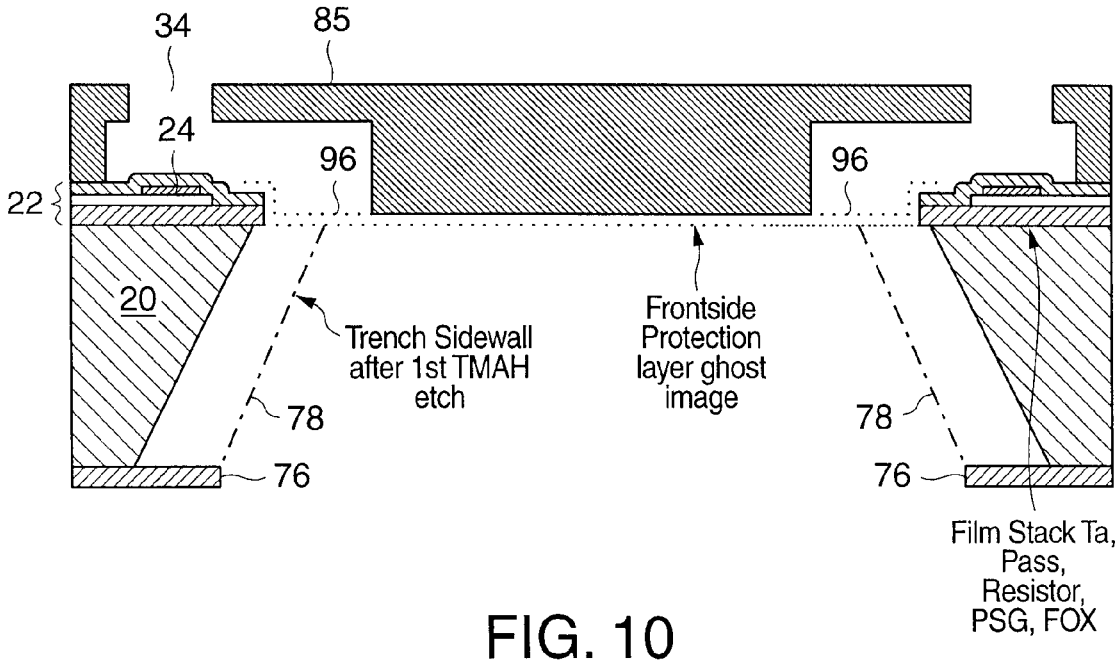

FIGS. 9 and 10 illustrate a variation of the structures of FIGS. 7 and 8, where an ink feed hole mask 92, followed by an etch, is used to form a large central rectangular opening 98 in the thin film layers 22. A frontside protection mask 94 is used to form the protection layer 96 (FIG. 10). The orifice layer 85 forms part of the boundary of the ink feed holes.

Figure 11:
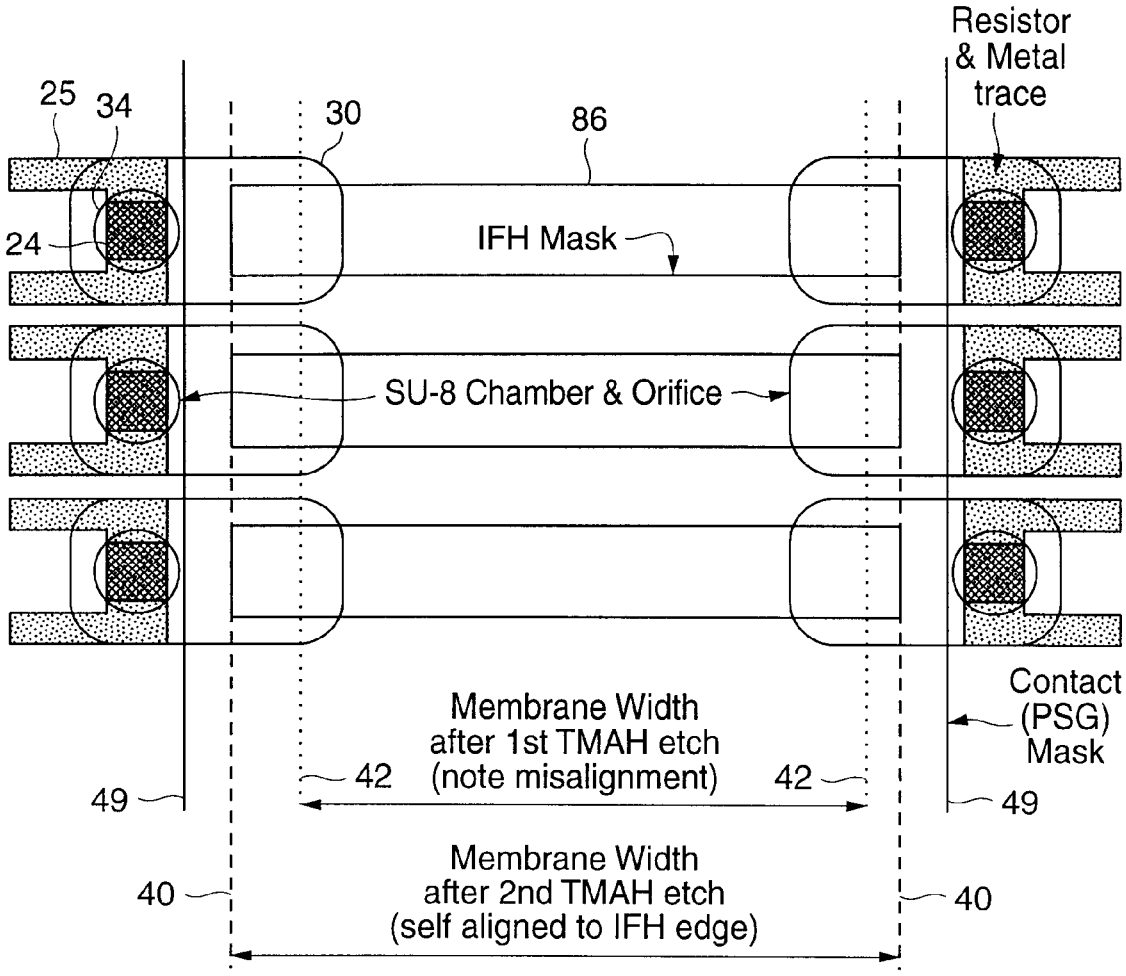
FIGS. 11 and 12 illustrate a further variation of the structures of FIGS. 7 and 8, where, instead of a separate protection layer being formed, the FOX layer is used as the protection layer.
Figure 12:
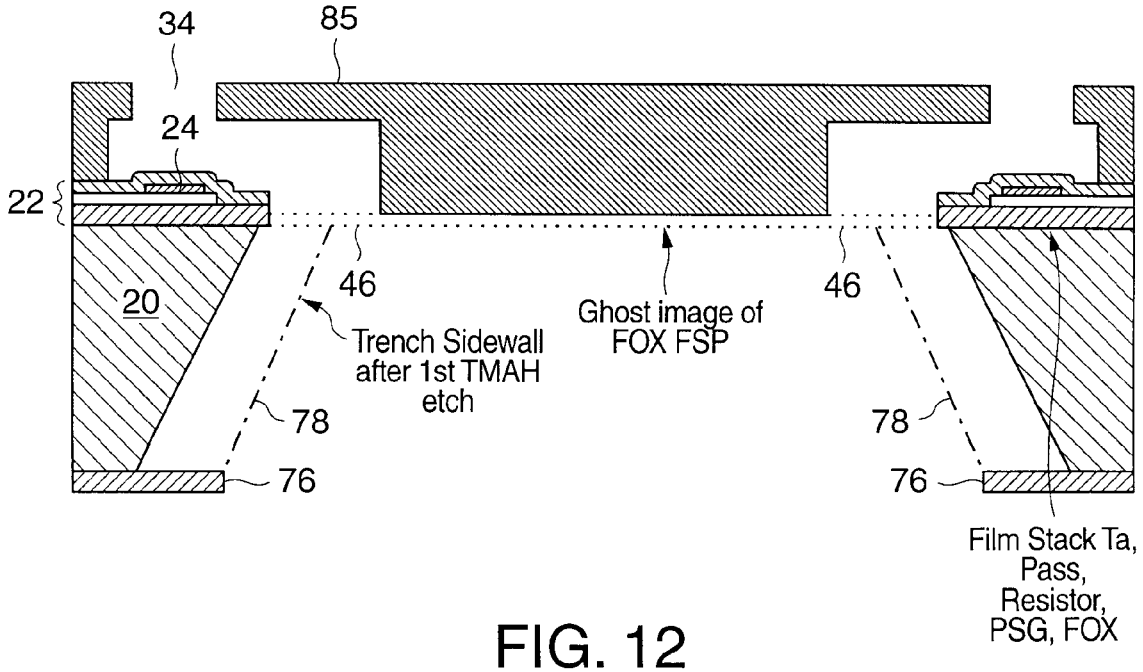

FIGS. 11 and 12 illustrate a variation of the processes described above, where no separate protection layer is formed. In this process, the FOX layer 46 (also shown in FIG. 6A) acts as the protection layer in the ink feed hole areas. In contrast to FIGS. 7 and 8, the thin film layers are etched only down to the FOX layer 46, using conventional techniques. After the first trench etch, the trench walls 78 are only roughly aligned with the ink feed holes. The exposed FOX layer 46 is then removed using a BOE or other suitable etch (the removed FOX layer is shown in ghost outline in FIG. 12). A second trench etch is performed, as before, resulting in the trench walls being aligned with the thin film openings. Although the ink feed hole mask 86 is shown to be similar to that of FIG. 7, the ink feed hole masks of FIGS. 3 and 9 may also be used. The process of FIGS. 11 and 12 saves considerable expense in processing wafers by deleting the formation of a separate protection layer.

A short membrane shelf hanging over the trench walls is shown in the various figures to illustrate that the second etch time is not critical. After the trench walls have been etched past the thin film openings, the etch of the substrate slows considerably.

One skilled in the art of integrated circuit manufacturing would understand the various techniques used to form the printhead structures described herein. The thin film layers and their thicknesses may be varied, and some layers deleted, while still obtaining the benefits of the present invention. Additional ink feed hole patterns are also envisioned.

Figure 13:
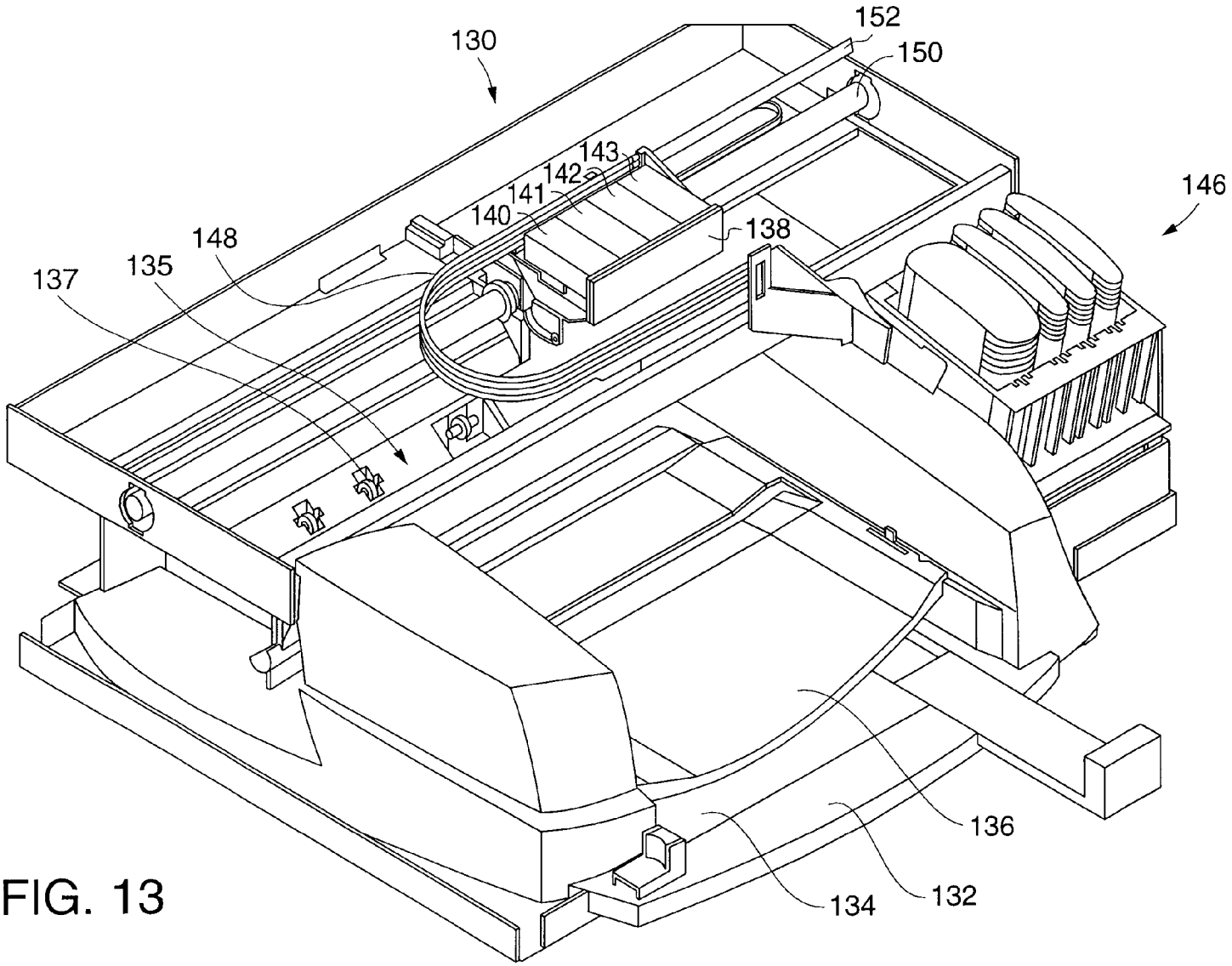
FIG. 13 is a perspective view of a conventional inkjet printer into which the printheads of the present invention may be installed for printing on a medium.

FIG. 13 illustrates one embodiment of an inkjet printer 130 that can incorporate the invention. Numerous other designs of inkjet printers may also be used along with this invention. More detail of an inkjet printer is found in U.S. Pat. No. 5,852,459, to Norman Pawlowski et al., incorporated herein by reference.

Inkjet printer 130 includes an input tray 132 containing sheets of paper 134 which are forwarded through a print zone 135, using rollers 137, for being printed upon. The paper 134 is then forwarded to an output tray 136. A moveable carriage 138 holds print cartridges 140–143, which respectively print cyan (C), black (K), magenta (M), and yellow (Y) ink.

In one embodiment, inks in replaceable ink cartridges 146 are supplied to their associated print cartridges via flexible ink tubes 148. The print cartridges may also be the type that hold a substantial supply of fluid and may be refillable or non-refillable. In another embodiment, the ink supplies are separate from the printhead portions and are removeably mounted on the printheads in the carriage 138.

The carriage 138 is moved along a scan axis by a conventional belt and pulley system and slides along a slide rod 150. In another embodiment, the carriage is stationery, and an array of stationary print cartridges print on a moving sheet of paper.

Printing signals from a conventional external computer (e.g., a PC) are processed by printer 130 to generate a bitmap of the dots to be printed. The bitmap is then converted into firing signals for the printheads. The position of the carriage 138 as it traverses back and forth along the scan axis while printing is determined from an optical encoder strip 152, detected by a photoelectric element on carriage 138, to cause the various ink ejection elements on each print cartridge to be selectively fired at the appropriate time during a carriage scan.

The printhead may use resistive, piezoelectric, or other types of ink ejection elements.

As the print cartridges in carriage 138 scan across a sheet of paper, the swaths printed by the print cartridges overlap. After one or more scans, the sheet of paper 134 is shifted in a direction towards the output tray 136, and the carriage 138 resumes scanning.

The present invention is equally applicable to alternative printing systems (not shown) that utilize alternative media and/or printhead moving mechanisms, such as those incorporating grit wheel, roll feed, or drum or vacuum belt technology to support and move the print media relative to the printhead assemblies. With a grit wheel design, a grit wheel and pinch roller move the media back and forth along one axis while a carriage carrying one or more printhead assemblies scans past the media along an orthogonal axis. With a drum printer design, the media is mounted to a rotating drum that is rotated along one axis while a carriage carrying one or more printhead assemblies scans past the media along an orthogonal axis. In either the drum or grit wheel designs, the scanning is typically not done in a back and forth manner as is the case for the system depicted in FIG. 13.

Multiple printheads may be formed on a single substrate. Further, an array of printheads may extend across the entire width of a page so that no scanning of the printheads is needed; only the paper is shifted perpendicular to the array.

Additional print cartridges in the carriage may include other colors or fixers.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method for forming a printing device comprising:

providing a printhead substrate;

forming a plurality of thin film layers on a first surface of said substrate, at least one of said layers forming a plurality of ink ejection elements;

forming ink feed openings through at least some of said thin film layers;

providing a protection layer between said ink feed openings and said substrate;

masking a second surface of said substrate to perform a trench etch;

etching said second surface of said substrate to form a first trench portion;

removing said protection layer at least between said ink feed openings and said substrate; and further etching said portions of said substrate exposed through said ink feed openings to self-align edges of said trench substantially to said ink feed openings.

2. The method of claim 1 wherein said thin film layers include a field oxide layer, said protection layer being a portion of said field oxide layer remaining after said thin film layers are etched to form said ink feed openings.

3. The method of claim 1 wherein said providing a protection layer comprises forming a protection layer within said ink feed openings after said ink feed openings are formed.

4. The method of claim 1 wherein said forming ink feed openings comprises forming openings completely through said thin film layers.

5. The method of claim 1 further comprising forming an orifice layer over said thin film layers, said orifice layer defining a plurality of ink ejection chambers, each chamber having within it an ink ejection element, said orifice layer further defining a nozzle for each ink ejection chamber.

6. The method of claim 5 wherein said removing said protection layer comprises performing a wet etch such that a wet etchant enters said chambers and etches said protection layer.

7. The method of claim 5 wherein a central portion of said orifice layer overlies a thin film membrane.

8. The method of claim 5 wherein said orifice layer defines boundaries of ink feed holes formed in part by said ink feed openings.

9. The method of claim 1 wherein said providing a protection layer comprises depositing TEOS.

10. The method of claim 1 wherein said providing a protection layer comprises depositing material selected from the group consisting of oxides, nitrides, and oxinitrides.

11. The method of claim 1 wherein said providing a protection layer comprises forming a protection layer over an area greater than an ink feed opening area.

12. The method of claim 1 wherein said forming ink feed openings comprises forming ink feed openings only in the vicinity of each ink ejection element.

13. The method of claim 1 wherein forming ink feed openings comprises forming elongated ink feed openings extending across a central portion of said substrate.

14. The method of claim 1 wherein forming ink feed openings comprising forming a rectangular ink feed opening in a central portion of said substrate.

15. The method of claim 1 wherein a bottom layer of thin film layers, directly adjacent said substrate, and said protection layer act as an etch stop for said etching said second surface of said substrate to form said first trench portion.

16. The method of claim 1 wherein said etching said second surface of said substrate to form a first trench portion comprises etching said substrate with a TMAH solution to form an angled trench edge with respect to said second surface.

17. A printhead during fabrication comprising:

a printhead substrate;

a plurality of thin film layers formed on a first surface of said substrate, at least one of said layers forming a plurality of ink ejection elements;

ink feed openings formed through at least some of said thin film layers;

a protection layer between said ink feed openings and said substrate;

a trench etched through said substrate to said protection layer between said ink feed openings and said substrate, said protection layer between said ink feed openings and said substrate for being removed followed by a second trench etch to form a trench having walls substantially aligned with said ink feed openings.

18. The device of claim 17 wherein said thin film layers include a field oxide layer, said protection layer being a portion of said field oxide layer remaining after said thin film layers are etched.

19. The device of claim 17 wherein said protection layer is formed within said ink feed openings after said ink feed openings are formed.

20. The device of claim 17 wherein said ink feed openings are formed completely through said thin film layers.

21. The device of claim 17 further comprising an orifice layer formed over said thin film layers, said orifice layer defining a plurality of ink ejection chambers, each chamber having within it an ink ejection element, said orifice layer further defining a nozzle for each ink ejection chamber.

22. A method for forming a through hole comprising:

providing a s substrate;

forming a plurality of thin film layers on a first surface of said substrate;

forming openings through at least some of said thin film layers;

providing a protection layer between said openings and said substrate;

masking a second surface of said substrate to perform a trench etch;

etching said second surface of said substrate to form a first trench portion;

removing said protection layer between said openings and said substrate; and further etching said portions of said substrate exposed through said openings to self-align edges of said trench substantially to said openings.

23. The method of claim 22 wherein said thin film layers include a field oxide layer, said protection layer being a portion of said field oxide layer remaining after said thin film layers are etched to form said openings.

24. The method of claim 22 wherein said providing a protection layer comprises forming a protection layer within said openings after said openings are formed.

25. The method of claim 22 wherein said forming openings comprises forming openings completely through said thin film layers.

26. The method of claim 22 wherein said providing a protection layer comprises depositing TEOS.

27. The method of claim 22 wherein said providing a protection layer comprises depositing material selected from the group consisting of oxides, nitrides, and oxinitrides.

28. The method of claim 22 wherein said providing a protection layer comprises forming a protection layer over an area greater than an opening area.

29. The method of claim 22 wherein said etching said second surface of said substrate to form a first trench portion comprises etching said substrate with a TMAH solution to form an angled trench edge with respect to said second surface.

* * * * *